US006297485B1

(12) United States Patent
Kim et al.

(10) Patent No.: US 6,297,485 B1
(45) Date of Patent: Oct. 2, 2001

(54) MICROWAVE OVEN HAVING BIDIRECTIONAL MICROWAVE FLOW CHANNELS

(75) Inventors: Yang Kyeong Kim, Inchon; Jong Gwan Ryu, Seoul, both of (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/604,998

(22) Filed: Jun. 28, 2000

(30) Foreign Application Priority Data

Jun. 28, 1999 (KR) ..... 99-24688

(51) Int. Cl.[7] ..... H05B 6/80; H05B 6/70

(52) U.S. Cl. ..... 219/680; 219/681; 219/746; 219/756; 219/757

(58) Field of Search ..... 219/680, 681, 219/746, 756, 757, 758, 759, 685

(56) References Cited

U.S. PATENT DOCUMENTS 3,783,220 * 1/1974 Tanizaki ..... 219/759
4,042,850 * 8/1977 Ury et al. ..... 315/39
5,420,390 * 5/1995 Abe ..... 219/121.36

FOREIGN PATENT DOCUMENTS 1-200590 * 8/1989 (JP) ..... 219/746
3-129696 * 6/1991 (JP) ..... 219/746

* cited by examiner

*Primary Examiner*—Philip H. Leung

(57) ABSTRACT

The present invention relates to a microwave oven including a cavity having a certain area for cooking, a magnetron installed at the outside of the cavity for generating microwave, a waveguide installed at the side of the magnetron and its end extended inside of the cavity for transmitting the microwave inside of the cavity. The microwave oven comprises a bidirectional flow channel formed inside of the waveguide for transmitting microwave selectively inside of the cavity in accordance with cooking function, a microwave plate combined to inside of the waveguide so as to be rotational for guiding the microwave to selected direction between the two direction of the flow channel, and a plasma lamp installed adjacent to the side of the bidirectional flow channel for generating radiant energy by being heated by the microwave. Accordingly the microwave oven of the present invention is capable of efficient cooking by including both convection cooking and grill cooking functions, and speed cooking by convection-performing the radiant energy of the plasma lamp.

3 Claims, 4 Drawing Sheets

MICROWAVE OVEN HAVING BIDIRECTIONAL MICROWAVE FLOW CHANNELS

BACKGROUND OF THE INVENTION

1. Field of the Invention

The present invention relates to a microwave oven, and in particular to a microwave oven which is capable of convection cooking and grill cooking by including an apparatus generating radiant heat and convection-performing the radiant heat inside of a cavity.

2. Description of the Prior Art

A microwave oven cooks foodstuff by utilizing molecular motion of the foodstuff which is generated by microwave.

The conventional microwave oven will now be described.

As depicted in FIG. 1, a door 15 having a transparent door screen 14 is installed on the front of the mainframe as hinged gate, a control panel 16 for setting functions and cooking time is installed on the side of the door 15.

The conventional microwave oven having convection cooking function will now be described.

As depicted in FIG. 2, there is a cooking cavity 2*a* having a certain area for cooking inside of the mainframe 1*a*, a magnetron 3 is installed on the outer side of the cavity 2*a*, a waveguide 17 is formed at the side of the magnetron 3 for guiding microwave inside of the cavity 2*a*.

A turntable 9 is placed on the inner bottom surface of the cavity 2*a* to be mounted on the food stuff, a motor shaft 8 is connected to the center portion of the bottom surface of the turntable 9, the motor shaft is extended outwardly and connected to a turntable operation motor 7.

A heater 18 covered by a heater chamber 19 generating heat for convection cooking is placed at the outer side of the cavity 2*a*, a blast fan 23 placed at the side of the heat chamber 19 for circulating the heat generated by the heater 18 inside of the cavity 2*a* is connected to a operating motor 20, a convection cooking table 24 is installed at the center portion of the cavity 2*a* so as to be removable.

Herein, a plurality of vent holes 22 are formed at the wall surface of the cavity 2*a* where the heater 18 is installed in order to circulate the heat of the heater 18 inside of the cavity 2*a*.

The convection microwave oven is mainly used to cook bread, in the cooking process, the bread is placed on the convection cooking table 24, the heater 18 and blast fan 23 operate to generate heat from the heater 18 and circulate the heat inside of the cavity 2*a*, and keep temperature inside of the cavity 2*a* uniformly while the bread is cooked.

The conventional grill cooking microwave oven will now be described. As depicted in FIG. 3, a cavity 2*a* having a certain area is formed inside of a mainframe 1*a* for cooking foodstuff, a magnetron 3 is installed at the outer side of the cavity 2*a* for generating microwave, a waveguide 17 is formed at the side of the magnetron for guiding microwave inside of the cavity 2*a*.

A turntable 9 is placed on the inner bottom surface of the cavity 2*a* to be mounted on the foodstuff, a motor shaft 8 is connected to the center bottom portion of the turntable 9, the motor shaft 8 is extended outwardly and connected to a turntable operation motor 7.

A heater 25 supported by a heater holder 24 is installed at the outer upper portion of the cavity 2*a*, a reflector 26 is installed at the outer upper portion of the cavity 2*a* adjacent to the heater 25 for reflecting the heat generated by the heater 25 inside of the cavity 2*a*.

The grill cooking microwave oven is mainly used to cook meat, in the cooking process, the meat is placed on the turntable 9, the heater operates to generate heat, the heat generated by the heater 25 and the reflected heat by the reflector 26 are transmitted inside of the cavity 2*a*.

However, in the above-mentioned convection cooking microwave oven, controlling the temperature inside of the cavity is difficult due to non-uniformity of heat distribution, because of the distance between the heater 18 and the foodstuff, portions adjacent to the heater 18 has high temperature, the opposite wall portion from the heater 18 has low temperature. In order to uniform the heat distribution, the blast fan 23 is installed at the side of the heater, but the circulated air flow interferes with the heat flow generated by the heater 18, accordingly the heat can not be transmitted properly to the opposite wall inside of the cavity 2*a*.

In addition, the conventional grill cooking microwave oven, non-uniformity of the heat distribution may occur because of the distance between the heater and the foodstuff, and it requires long time to get enough temperature inside of the cavity because it only uses convection heat transfer having limited 600° C. surface temperature.

Furthermore, both heating apparatus are separately required for each convection cooking and grill cooking in the conventional microwave oven.

SUMMARY OF THE INVENTION

It is an object of the present invention to provide a microwave oven which is capable of convection cooking and grill cooking, and efficient and speed cooking by uniformity of heat distribution inside of a cavity.

To achieve the objects, there is provided a microwave oven comprising a cavity having a certain area for cooking, a magnetron installed outside of the cavity for generating microwave, a waveguide installed on the side of the magnetron and its end extended inside of the cavity for transmitting microwave inside of the cavity.

The waveguide includes a bidirectional flow channel for transmitting microwave selectively inside of the cavity in accordance with cooking function. A microwave guide plate is installed inside of the waveguide so as to be rotational for guiding the microwave to selected direction between the two direction of the flow channel. A plasma lamp is installed adjacent to the side of the flow channel in order to generate radiant heat by being heated by the microwave.

In the present invention, it is advisable for a blast pan to be installed at the side of the plasma lamp in order to circulate high temperature heat generated by the plasma lamp inside of the cavity.

It is advisable for the outer surface of the plasma lamp to be coated with far infrared ray in order to make the reflected light from the plasma into far infrared radiation condition.

DETAILED DESCRIPTION OF THE PREFERRED EMBODIMENTS

Preferred embodiment of the present invention will be described in detail with reference to the accompanying drawings.

Figure 1:
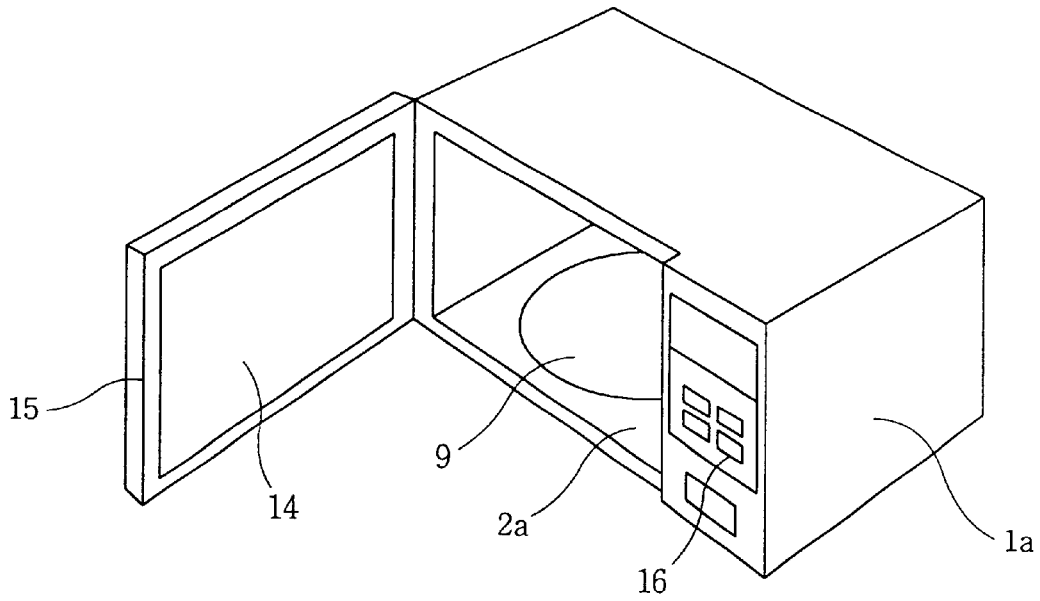
FIG. 1 PRIOR ART
FIG. 1 is a schematic perspective view illustrating outward of the conventional microwave oven.
Figure 2:
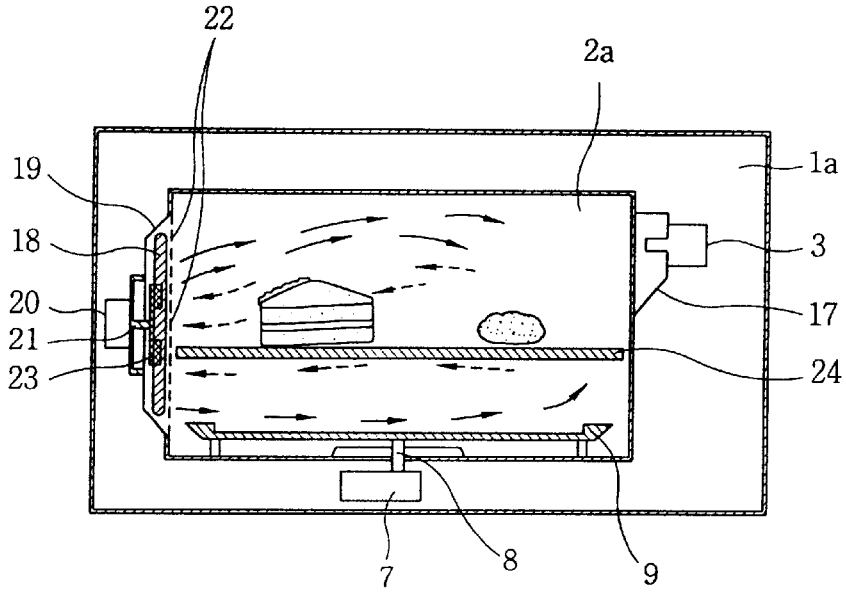
FIG. 2 PRIOR ART
FIG. 2 is a schematic sectional view illustrating the conventional microwave oven having a convection cooking function.
Figure 3:
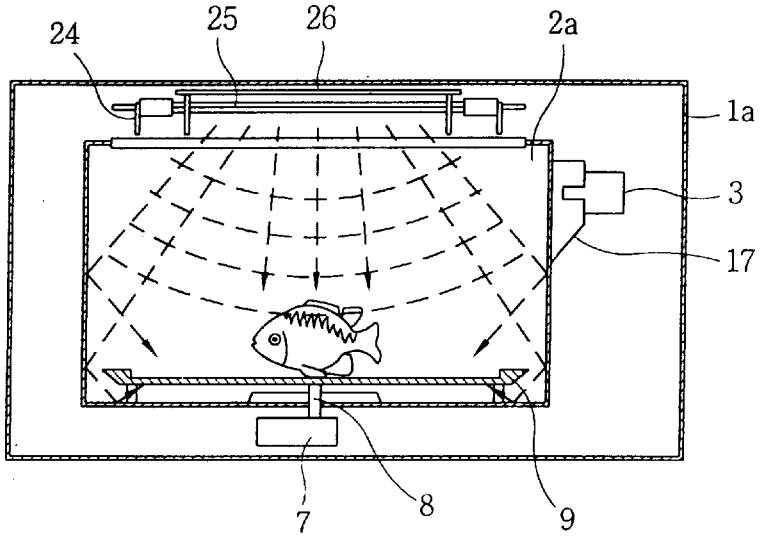
FIG. 3 PRIOR ART
FIG. 3 is a schematic sectional view illustrating the conventional microwave oven having a grill cooking function.
Figure 4:
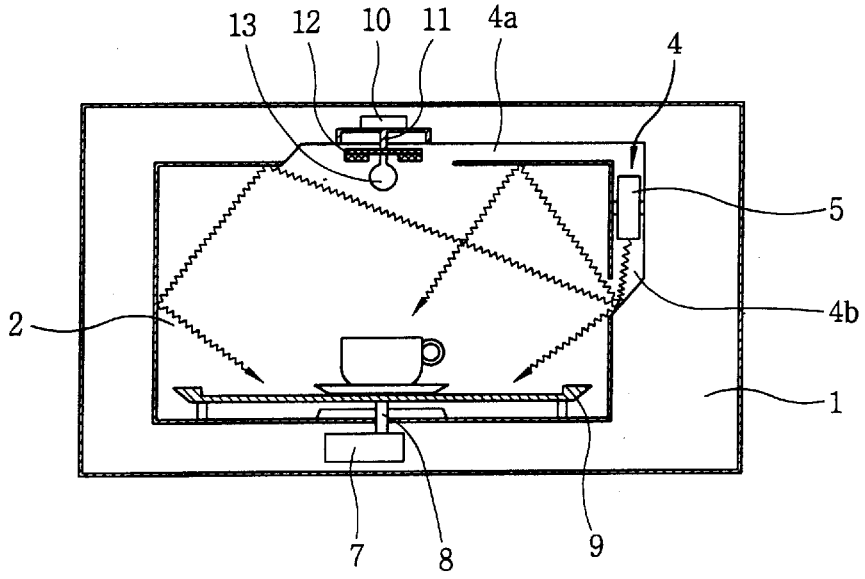
FIG. 4 is a front schematic sectional view illustrating convection cooking operation of the preferred embodiment of the present invention.
Figure 7:
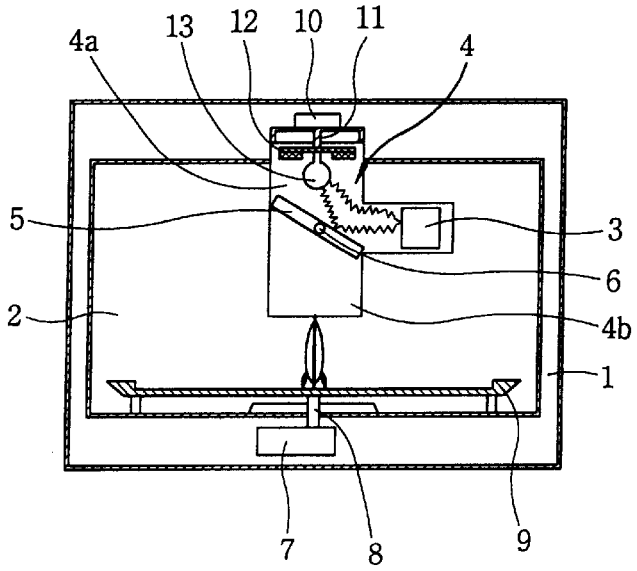
FIG. 7 is a side schematic sectional view of FIG. 6.

As depicted in FIG. 4 and FIG. 7, a microwave oven of the present invention comprises a cavity 2 having a certain area for cooking foodstuff, a magnetron 3 installed on the outside of the cavity 2, a waveguide 4 having a bidirectional flow channel 4*a* 4*b*, a microwave guide plate 5 installed inside of the waveguide 4, a plasma lamp 13 installed adjacent to the side of the flow channel of the waveguide 4.

The waveguide 4 having pipe shape is installed at the side of the magnetron 3 for guiding microwave inside of the cavity 2 and has the bidirectional flow channel 4*a*·4*b*, the end of the flow channel faces a turntable 9 installed at the inner bottom surface of the cavity 2, the other end of the flow channel faces the plasma lamp installed at the inner ceiling surface of the cavity 2.

The microwave guide plate 5 having board plank shape is hinge-connected to the boundary portion of the flow channel straight-toward to the magnetron 3 so as to be rotational, it is rotated and controlled by a control unit (not shown) as a certain degree in order to guide microwave selectively to the turntable 9 or the plasma lamp 13.

The plasma lamp 13 is installed at the ceiling surface of the cavity 2 adjacent to the end of the flow channel of the waveguide 4 and includes sealed plasma generating elements in order to generate high temperature radiant energy by heat of the microwave, the surface of the plasma lamp is coated with far infrared ray in order to make emitted light into far infrared radiation condition.

A blast fan 12 is installed on the upper portion of the plasma lamp 13 for circulating the high temperature heat generated by the plasma lamp 13 downwardly and is connected to a operation motor 10 of a motor shaft 11.

A turntable 9 installed at the inner bottom surface of the cavity 2 is connected to a turntable operation motor 7 by the motor shaft 8.

A non-described reference numeral 6 is a rotation shaft of the microwave guide plate 5.

Figure 5:
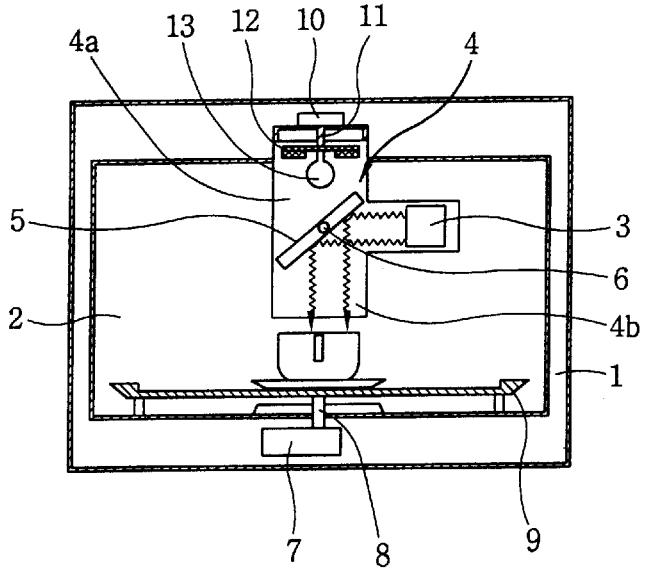
FIG. 5 is a side schematic sectional view of FIG. 4.

As depicted in FIG. 4 and FIG. 5, in order to cook the foodstuff by using the microwave, the foodstuff is mounted on the turntable 9 inside of the cavity 2, the control unit operates to open the flow channel 4*a* toward the turntable 9, at the same time the microwave guide plate is rotated in order to close the other flow channel 4*b*, and the magnetron 3 generates microwave.

The microwave is guided inside of the cavity 2 along the flow channel 4*b* of the waveguide 4, accordingly the foodstuff can be cooked.

Figure 6:
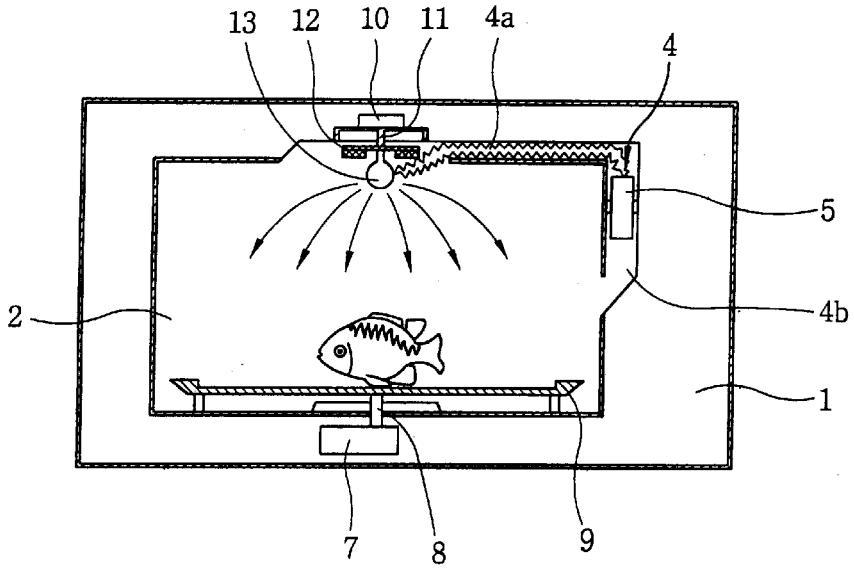
FIG. 6 is a front schematic sectional view illustrating grill cooking operation of the preferred embodiment of the present invention.

As depicted in FIG. 6 and FIG. 7, in order to cook the food stuff by the heater, the microwave guide plate 5 operates to open the flow channel 4*a* toward the plasma lamp 13, at the same time to close the other flow channel 4*b*, and the magnetron 3 generates microwave.

The microwave is guided to the plasma lamp 13 installed at the ceiling of the cavity 2 along the flow channel 4*a* of the waveguide 4 and heats the plasma lamp 13.

The heated plasma lamp 13 is filled with the high temperature plasma elements by the microwave, the surface temperature of the plasma lamp 13 is about 1000° C. and emits strong ray of light, accordingly the foodstuff can be grill-cooked.

Herein, the outer surface of the plasma lamp 13 is coated with far infrared ray, the emitted light of the plasma has far infrared radiation condition by passing through the surface of the plasma lamp 13, accordingly the plasma lamp 13 can emit strong radiant energy, the radiant energy makes the temperature of the cavity 2 uniform regardless of the distance of the foodstuff.

The radiant heat of the surface of the plasma lamp 13 can rises the temperature inside cavity 2 due to downward-convection of the blast fan 12, the radiant energy convection is repeated, accordingly the foodstuff can be convection-cooked.

As described above, the microwave oven of the present invention is capable of efficient cooking by including both convection cooking and grill cooking functions, and speed cooking by convection-performing the radiant energy of the plasma lamp.

What is claimed is:

1. A microwave oven including a cavity defining a cooking area a magnetron positioned outside said cavity for generating microwaves, a waveguide adjacent said magnetron and extending into said cavity for transmitting microwaves into said cavity, said microwave oven further comprising:

a bidirectional flow channel formed inside said waveguide for transmitting microwaves selectively into said cavity defining a cooking area in accordance with desired cooking function;

a microwave guide plate positioned in said waveguide for guiding said microwaves between one of two directions of said bidirectional flow channel in said waveguide;

means to rotate said microwave guide plate between selected positions whereby said microwaves are directed in one of said selected two directions of said bidirectional flow channel; and a plasma lamp adjacent said bidirectional flow channel and positioned within said cavity for generating radiant energy upon being heated by microwaves directed from one of said directions of said bidirectional flow channel.

2. The microwave oven according to claim 1, further comprising a blast fan adjacent said plasma lamp for circulating heat generated by the plasma lamp inside of said cavity.

3. The microwave oven according to claim 1, wherein the plasma lamp includes means to convert emitted light from the plasma into infrared radiation.

* * * * *